US006388542B2

(12) United States Patent
Hiratsuka et al.

(10) Patent No.: US 6,388,542 B2
(45) Date of Patent: May 14, 2002

(54) DIELECTRIC FILTER, TRANSMISSION-RECEPTION SHARING UNIT, AND COMMUNICATION DEVICE

(75) Inventors: Toshiro Hiratsuka, Kusatsu; Tomiya Sonoda, Muko; Kenichi Iio, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/751,108

(22) Filed: Dec. 29, 2000

Related U.S. Application Data

(63) Continuation of application No. 09/295,829, filed on Apr. 21, 1999, now abandoned.

(30) Foreign Application Priority Data

Apr. 23, 1998 (JP) ..... 10-113295

(51) Int. Cl.[7] ..... H01P 1/213; H01P 1/20
(52) U.S. Cl. ..... 333/134; 333/202
(58) Field of Search ..... 333/202, 219.1, 333/134

(56) References Cited

U.S. PATENT DOCUMENTS 4,714,903 A * 12/1987 Brand ..... 333/110
6,016,090 A * 1/2000 Iio et al. ..... 333/202
6,057,745 A * 5/2000 Sonoda et al. ..... 333/134

FOREIGN PATENT DOCUMENTS

EP 0841714 A1 * 5/1998

* cited by examiner

*Primary Examiner*—Benny Lee
*Assistant Examiner*—Stephen E. Jones
(74) *Attorney, Agent, or Firm*—Ostrolenk, Faber, Gerb & Soffen, LLP

(57) ABSTRACT

A dielectric filter, a transmission-reception shared unit, and a transceiver, which incorporate the filter, are disclosed; in which spurious modes such as HE110 mode, HE210 mode, HE310 mode, etc., can be suppressed so as to improve blocking-band attenuation characteristics. The dielectric filter comprises a dielectric plate; electrodes having electrodeless parts, which are formed on both main surfaces of the dielectric plate so as to form dielectric resonators; and probes disposed parallel to the line along which the dielectric resonators are aligned.

12 Claims, 13 Drawing Sheets

SPURIOUS CHARACTERISTICS OF BPF HAVING TWO DIELECTRIC RESONATORS

FIG. 12A
PRIOR ART

ELECTRIC FIELD ——
MAGNETIC FIELD - - - -

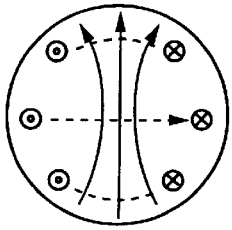

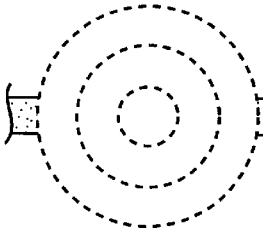

MEASURED VALUE:
11.63 GHz

CALCULATED VALUE:
11.66 GHz

HE 110

FIG. 12B
PRIOR ART

ELECTRIC FIELD ——
MAGNETIC FIELD - - - -

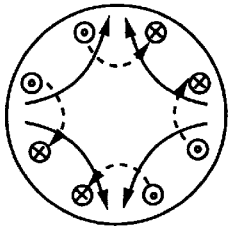

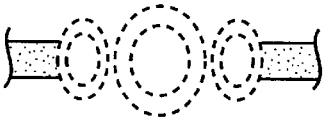

MEASURED VALUE:
16.78 GHz

CALCULATED VALUE:
17.08 GHz

HE 210

FIG. 12C
PRIOR ART

ELECTRIC FIELD ——
MAGNETIC FIELD - - - -

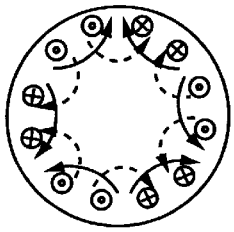

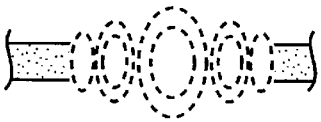

MEASURED VALUE:
21.33 GHz

CALCULATED VALUE:
21.90 GHz

HE 310

FIG. 12D
PRIOR ART

ELECTRIC FIELD ——
MAGNETIC FIELD - - - -

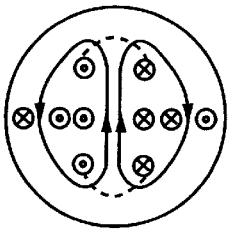

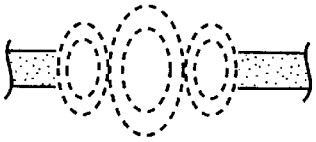

MEASURED VALUE:
24.85 GHz

CALCULATED VALUE:
25.56 GHz

TE 110

FIG. 12E
PRIOR ART

ELECTRIC FIELD ——
MAGNETIC FIELD - - - -

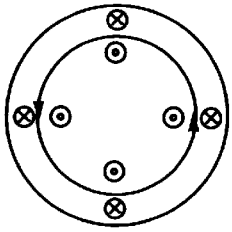

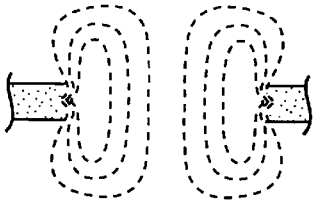

MEASURED VALUE:
19.90 GHz

CALCULATED VALUE:
20.0 GHz

TE 010

HE 110 MODE

HE 210 MODE

HE 310 MODE

TE 110 MODE

TE 010 MODE

DIELECTRIC FILTER, TRANSMISSION-RECEPTION SHARING UNIT, AND COMMUNICATION DEVICE

This is a continuation of application Ser. No. 09/295,829, filed Apr. 21, 1999 now abandoned.

BACKGROUND OF THE INVENTION

1. Field of the Invention

The present invention relates to a dielectric filter, a transmission-reception sharing unit, and a communication device for use in the microwave band and the millimeter-wave band.

2. Description of the Related Art

In order to achieve next-generation mobile and multimedia communications, ultra-fast transmission of a large amount of data is necessary. The millimeter-wave band having a large bandwidth can satisfy this requirement. In addition, in a field other than communications, shock-absorbing vehicle radar as a new form to take advantage of characteristics of the millimeter-wave band has been introduced. It is greatly anticipated that the millimeter-wave radar can ensure safety in fog or snow. Conventional laser radar using light lacks this capability.

When a conventional circuit structure composed almost exclusively of microstrip lines is used in a millimeter-wave band, loss increases due to reduction of Q. Furthermore, in a conventional type of widely used $TE_{01\delta}$ dielectric resonator, a large amount of resonant energy leaks out of the resonator. As a result, in the millimeter-wave band in which relative dimensions of a resonator and a circuit are small, undesirable coupling with the lines occurs, thereby creating difficulties in design and characteristic reproduction.

In order to solve these problems, a millimeter-wave band module using PDIC™ (Planer Dielectric Integrated Circuit) technology is mentioned. An example of such a high-module dielectric resonator is shown in Japanese Unexamined Patent Application Publication No. 8-265015.

In the dielectric resonator mentioned above, an electrode is formed on each of the main surfaces of a dielectric plate; parts of the electrode are electrodeless so that the electrodeless parts on the dielectric plate may function as a dielectric resonator.

FIGS. 10A, 10B, and 10C respectively show an example in which a plurality of dielectric resonators is formed on a dielectric plate to constitute a dielectric filter. FIG. 10A shows a state in which the upper conductor plate of the dielectric filter is removed; FIG. 10B is a sectional view taken along the line A—A in FIG. 10A; and FIG. 10C is a sectional view taken along the line B—B in FIG. 10A. In this figure, reference numeral 3 denotes a dielectric plate, on a first main surface of which an electrode 1 is formed having electrodeless parts 4*a* and 4*b;* and on a second main surface of the plate, an electrode 2 is formed having electrodeless parts 5*a* and 5*b* opposing the electrodeless parts 4*a* and 4*b*. Parts of the dielectric plate positioned between these electrodeless parts operate as TE010-mode dielectric resonators. Coaxial connectors 10 and 11 are formed in a cavity 8, and probes 6 and 7 are protruded from the respective central conductors thereof so as to respectively couple with the dielectric resonator. Magnetic-field coupling between the two resonators are allowed.

In the dielectric filter shown in FIGS. 10A, 10B, and 10C, spurious responses result in problems, as described below.

FIG. 11 shows attenuation characteristics of the dielectric filter shown in FIGS. 10A, 10B, and 10*c*. In this figure, responses of each mode are shown: reference characters (a) to (e) indicate HE110 mode, HE210 mode, HE310 mode, TE110 mode and TE010 mode respectively. As shown here, in addition to responses of the TE010 mode being the main mode, a number of unnecessary spurious responses occur. When these spurious responses coincide with frequencies in which specified attenuation levels are necessary, they may not satisfy requirements of the attenuation levels.

FIGS. 12A to 12E shows examples of magnetic field distributions of the above-indicated respective resonant modes. In these figures, solid lines indicate electric line of force, and broken lines indicate magnetic line of force. These lines show the magnetic field distributions. In each of the figures, the upper part shows a plan view of the dielectric resonator, and the lower part shows a view from the sectional direction of the dielectric plate.

FIGS. 13A to 13E show manners in which each mode may be coupling between the two adjacent dielectric resonators. As shown here, in any of the modes, magnetic-field coupling occurs between the adjacent dielectric resonators at their near parts.

SUMMARY OF THE INVENTION

The present invention provides a dielectric filter, a transmission-reception shared unit, and a transceiver, which incorporate the filter, in which spurious modes are suppressed to improve blocking-band attenuation characteristics.

The present invention also provides a dielectric filter including a dielectric plate; a first electrode formed on a first main surface of the dielectric plate, parts of the electrode being electrodeless; a second electrode formed on a second main surface of the dielectric plate, parts of the electrode opposed to the electrodeless parts of a first main surface being electrodeless; wherein the electrodeless parts on the dielectric plate form dielectric resonators; wherein the dielectric resonators are aligned linearly; and wherein an angle formed by the line and at least one of linearly-formed coupling members coupled with a specified one of the dielectric resonators is of a specified number of degrees other than 90 degrees.

Even in a spurious mode which couples between the aligned dielectric resonators, when the spurious mode is a mode which almost never couple with the linearly-formed coupling member forming a specified angle with the line along which the dielectric resonators are aligned, a response of the spurious mode is suppressed. For example, when the linearly-formed coupling member is disposed parallel to the line along which the dielectric resonators are aligned, responses of spurious modes such as HE110 mode, etc., are suppressed. In contrast, like the TE010 mode, when a mode capable of coupling, regardless of the angle formed by the coupling member and the dielectric resonator, is set as a main mode, there is no problem in terms of coupling in the main mode between the dielectric resonator and the coupling member, and also, coupling in the main mode between the adjacent dielectric resonators.

The other linearly-formed one of the coupling members coupled with a specified one of the dielectric resonators may be disposed perpendicular to the line along which the dielectric resonators are aligned.

In addition, since coupling with a specified spurious mode can be avoided according to the angle, the appropriate selection of the angle permits selective suppression of spurious modes.

Further, the present invention provides a dielectric filter including a dielectric plate; a first electrode formed on a first main surface of the dielectric plate, parts of the electrode being electrodeless; and a second electrode formed on a second main surface of the dielectric plate, parts of the electrode opposed to the electrodeless parts of a first main surface being electrodeless; wherein the electrodeless parts on the dielectric plate form dielectric resonators; and wherein the dielectric resonators are disposed in such a manner that the lines connecting the centers of respective adjacent dielectric resonators do not mutually coincide on the same line.

Even in the coupling of spurious modes between two adjacent dielectric resonators, the further-adjacent dielectric resonator is positioned at an angle, which differs from the transmitting direction of the spurious mode. Thus, this arrangement permits coupling with a specified spurious mode to be avoided according to the angle, and also permits selective suppression of spurious modes.

BRIEF DESCRIPTION OF THE DRAWINGS

FIGS. 12A through 12E show examples of magnetic-field distributions of respective conventional resonant modes.

DESCRIPTION OF THE PREFERRED EMBODIMENTS

Referring to FIGS. 1A to 1C and 2, a description will be given of a structure of a dielectric filter according to a first embodiment of the present invention.

Figure 1A:
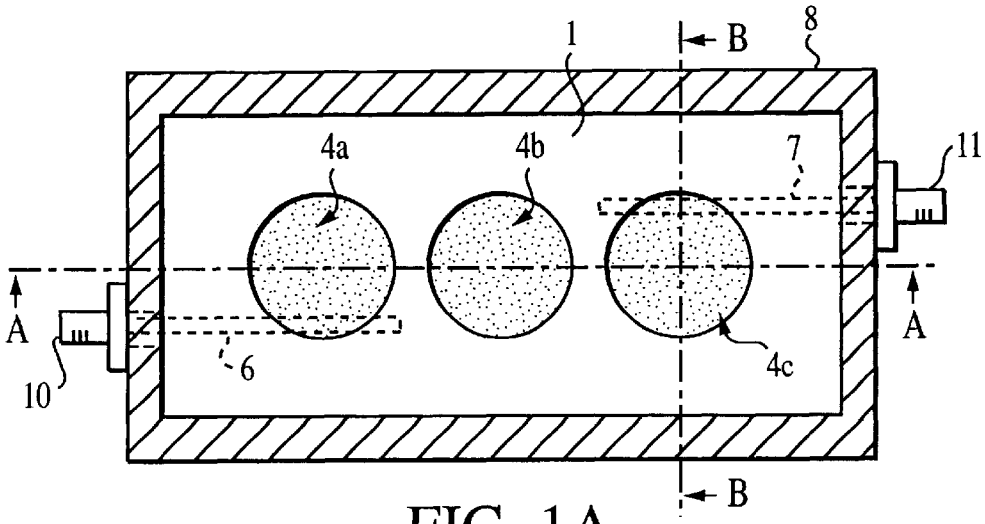
FIGS. 1A, 1B, and 1C are structural views of a dielectric filter according to a first embodiment of the present invention.
Figure 1B:
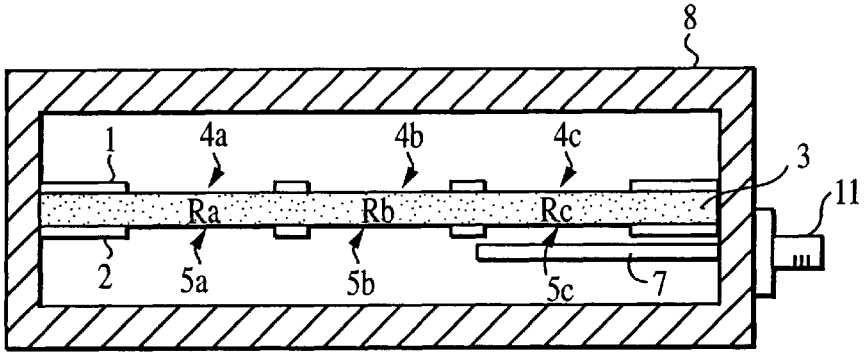
Figure 1C:
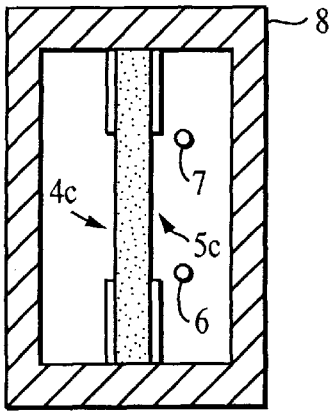

FIG. 1A shows a state in which the upper conductor plate of the dielectric filter is removed; FIG. 1B shows a section taken along the line A—A in FIG. 1A; and FIG. 1C shows a section taken along the line B—B in FIG. 1A. In this figure, reference numeral 3 denotes a dielectric plate, on a first main surface of which an electrode 1 is formed having electrodeless parts 4*a,* 4*b,* and 4*c;* and on a second main surface of the plate an electrode 2 is formed having electrodeless parts 5*a,* 5*b,* and 5*c* opposing the electrodeless parts 4*a,* 4*b,* and 4*c*. The parts of the dielectric plate positioned between these electrodeless parts function as TE010-mode dielectric resonators. Coaxial connectors 10 and 11 are disposed in a cavity 8 with probes 6 and 7 protruding from the central conductors thereof. The probes 6 and 7 are disposed parallel to the straight line along which the dielectric resonators are aligned. A dielectric resonator Ra composed of the electrodeless parts 4*a* and 5*a* is in a state in which it can resonate in the TE010 mode or in other spurious modes, and the probe 6 is coupled with those modes. In addition, a dielectric resonator Rc composed of the electrodeless parts 4*c* and 5*c* is in a state in which it can resonate in the TE010 mode or in other spurious modes, and the probe 7 is coupled with those modes. In contrast, a particular spurious mode almost never couples between adjacent resonators, namely, between Ra and Rb, and between Rb and Rc.

Figure 2:
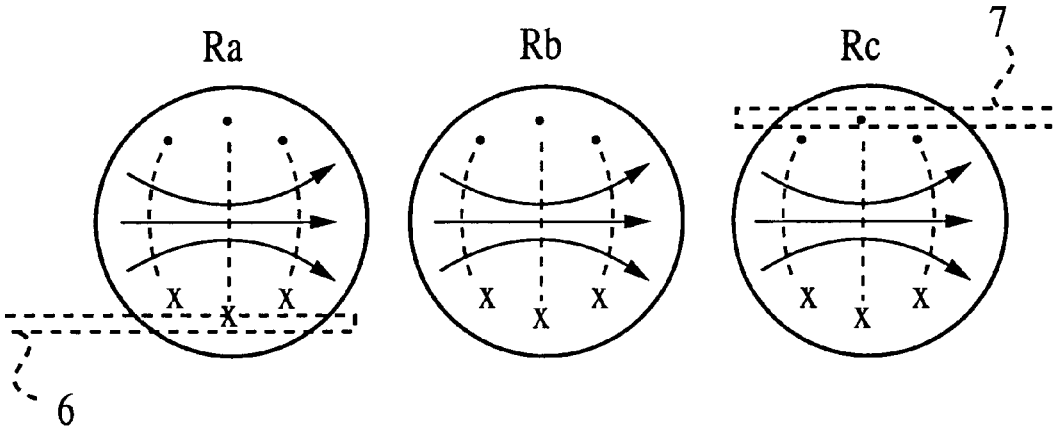
FIG. 2 shows the manner of transmission of a spurious mode in a first embodiment of the present invention.
Figure 13A:
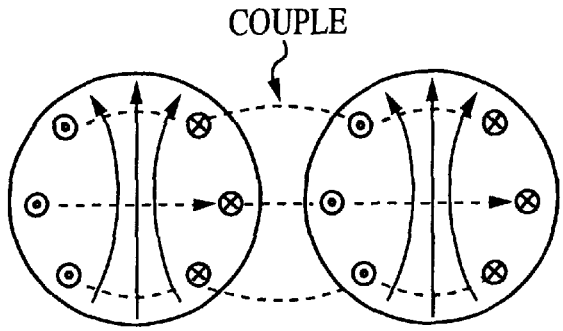
FIG. 13A PRIOR ART
FIGS. 13A through 13E show examples of coupling states in respective conventional resonant modes.
Figure 13B:
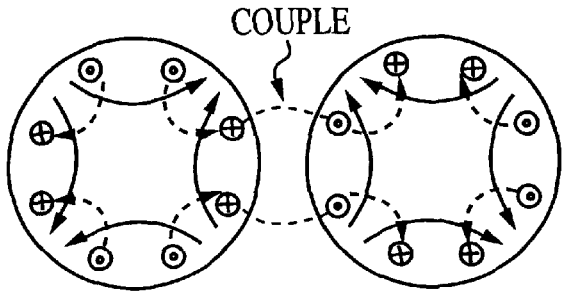
FIG. 13B PRIOR ART
Figure 13C:
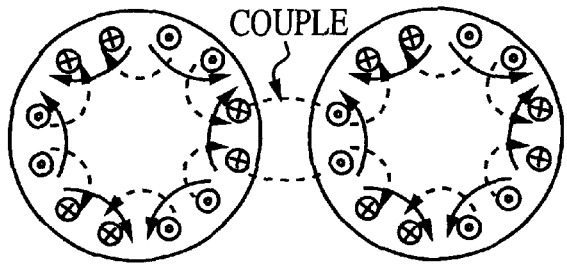
FIG. 13C PRIOR ART
Figure 13D:
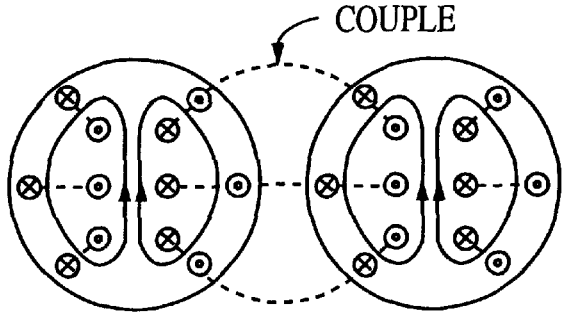
FIG. 13D PRIOR ART
Figure 13E:
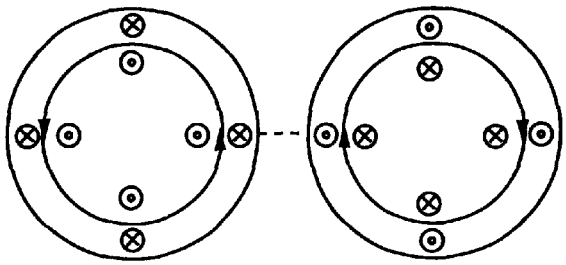
FIG. 13E PRIOR ART

FIG. 2 illustrates these states. Among the three dielectric resonators shown in FIG. 1A, a first resonator, for example, the dielectric resonator Ra is coupled with the probe 6 so as to resonate in the HE110 mode shown in the figure. However, coupling of the magnetic fields between the first resonator Ra and a second resonator Rb, and that between the second resonator Rb and a third resonator Rc, are unlikely to occur in the positional relationships as shown in FIG. 2. Thus, an HE110-mode signal is not transmitted between the probes 6 and 7, so that an HE110-mode spurious response can be effectively suppressed. In contrast, coupling of the TE010 mode, which is the main mode, between adjacent dielectric resonators occurs regardless of the angle formed by the probe and the dielectric resonator, as shown in FIG. 12E and FIG. 13E.

Figure 3A:
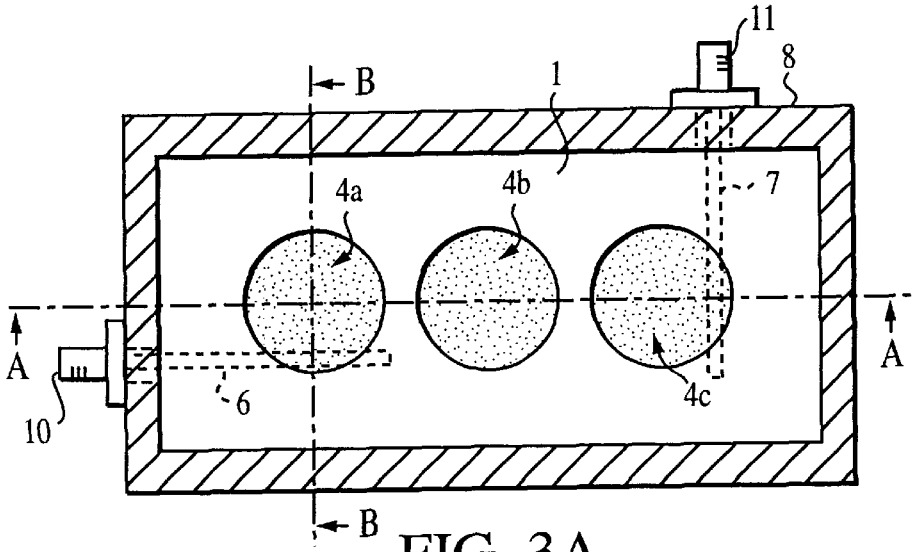
FIGS. 3A, 3B, and 3C show structural views of a dielectric filter according to a second embodiment of the present invention.
Figure 3B:
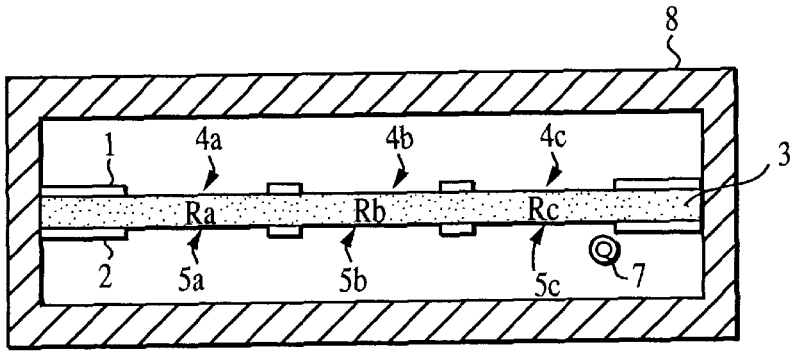
Figure 3C:
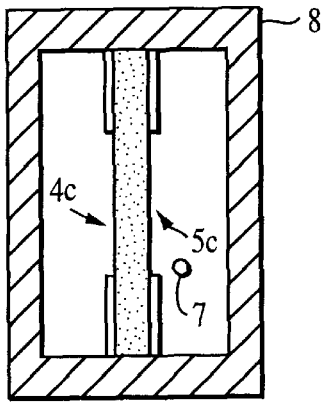

FIGS. 3A, 3B, and 3C respectively illustrate a structure of a dielectric filter according to a second embodiment of the present invention. The difference between the arrangement shown in FIGS. 1A, 1B, and 1C, and that shown in FIGS. 3A, 3B, and 3C is that the probe 7 is disposed in such a manner that it is perpendicular to the straight line along which the three dielectric resonators are aligned in these figures. The other arrangements are the same as those shown in FIGS. 1A to 1C. In this state, when a coaxial connector 11 is used as an input port and a coaxial connector 10 is used as an output port, the dielectric resonator Rc composed of the electrodeless parts 4*c* and 5*c* is excited in the TE010 mode, and it is also excited, for example, in the HE110 mode. These two modes are sequentially transmitted from the resonators Rc and Rb, to the resonator Ra. Although the probe 6 is coupled with the TE010 mode, it is almost never coupled with the HE110 mode, since the direction of the magnetic-field distributions in the mode is substantially parallel to the probe 6. Consequently, responses of the HE110 mode can be suppressed.

Figure 4A:
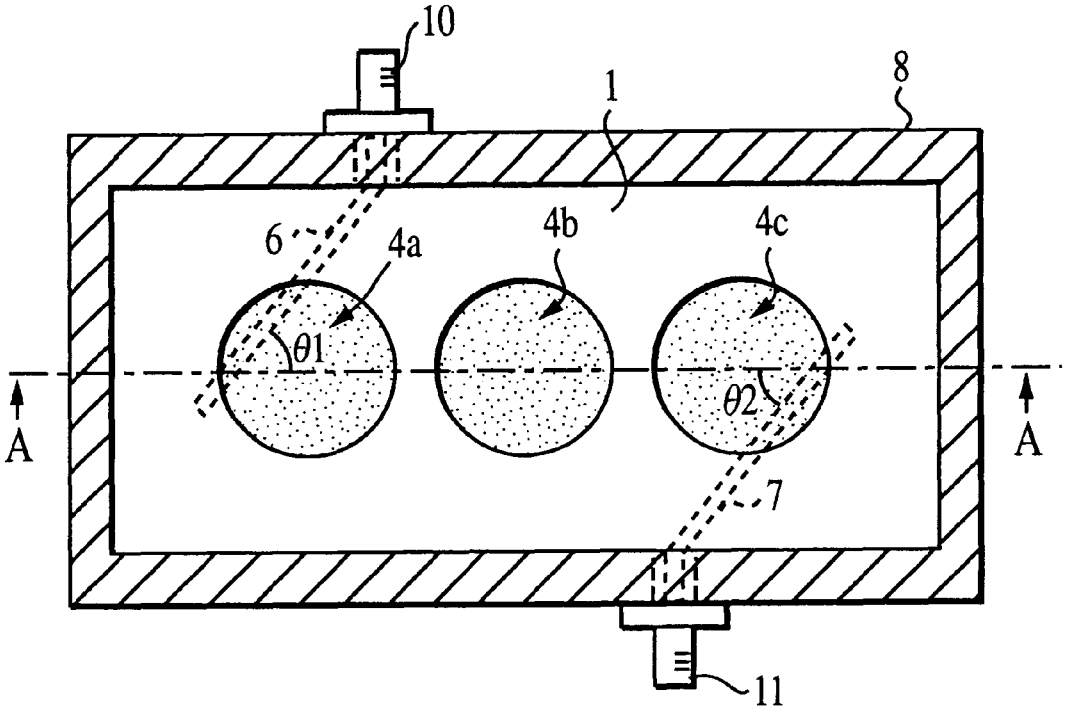
FIGS. 4A and 4B show structural views of a dielectric filter according to a third embodiment of the present invention.
Figure 4B:
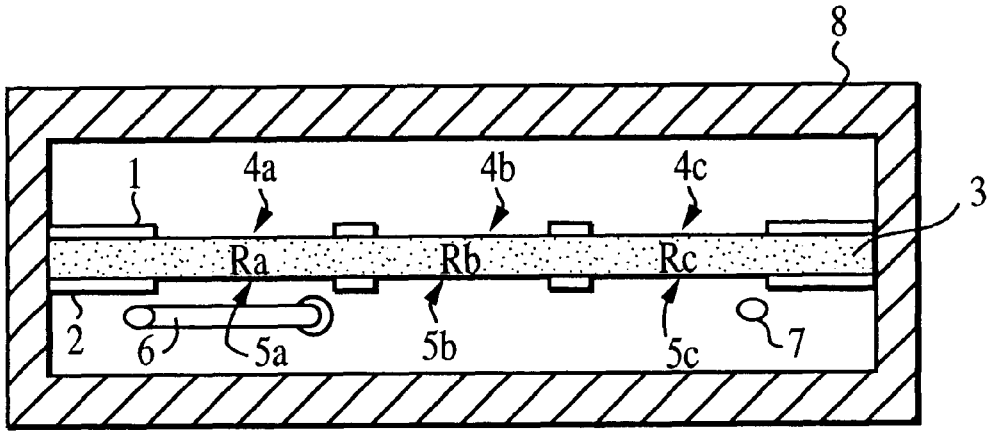

FIGS. 4A and 4B show structures of the dielectric filter according to a third embodiment of the present invention. The arrangement in these figures is different from that shown in the first embodiment and the second embodiment; the probes 6 and 7 are disposed at specified tilt angles θ1 and θ2 with respect to the straight line along which the three dielectric resonators are aligned. A particular spurious mode can be suppressed by setting values of the angles θ1 and θ2 to specified ones. For example, when the angles θ1 and θ2 are respectively set to 45 degrees, in the case in which adjacent dielectric resonators mutually couple in the HE210 mode, angles between the HE210 mode and the probes 6 and 7 are the most difficult to couple. This permits transmission of the HE210 mode to be blocked so as to suppress spurious responses of the HE210 mode. Similarly, when the angles θ1 and θ2 are respectively set to 30 degrees, spurious responses of the HE310 mode can be suppressed. In addition, when one of the angles θ1 and θ2 is set to 45 degrees, spurious responses of the HE210 mode can be suppressed; and when one of them is set to 30 degrees, spurious responses of the HE310 mode can be suppressed. Accordingly, when θ1 is set to 45 degrees and θ2 is set to 30 degrees, or when θ1 is set to 30 degrees and θ2 is set to 45 degrees, spurious responses of both the HE210 mode and the HE310 mode can be suppressed.

Next, a description will be given of a structure of the dielectric filter according to a fourth embodiment of the present invention with reference to FIGS. 5A, 5B, 6A, 6B, and 7.

Figure 5A:
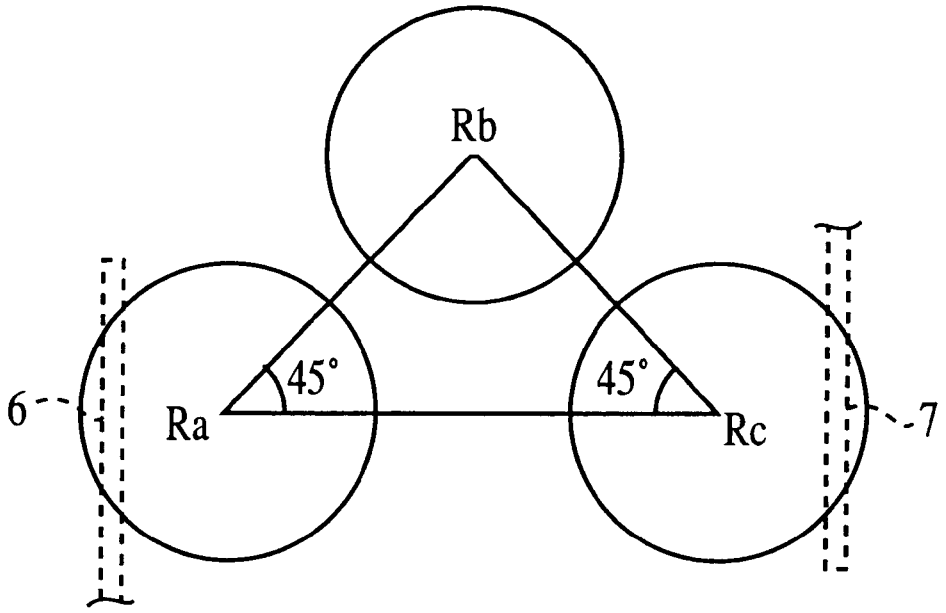
FIGS. 5A and 5B show an example in which each dielectric resonator of a dielectric filter according to a fourth embodiment of the present invention is disposed.
Figure 5B:
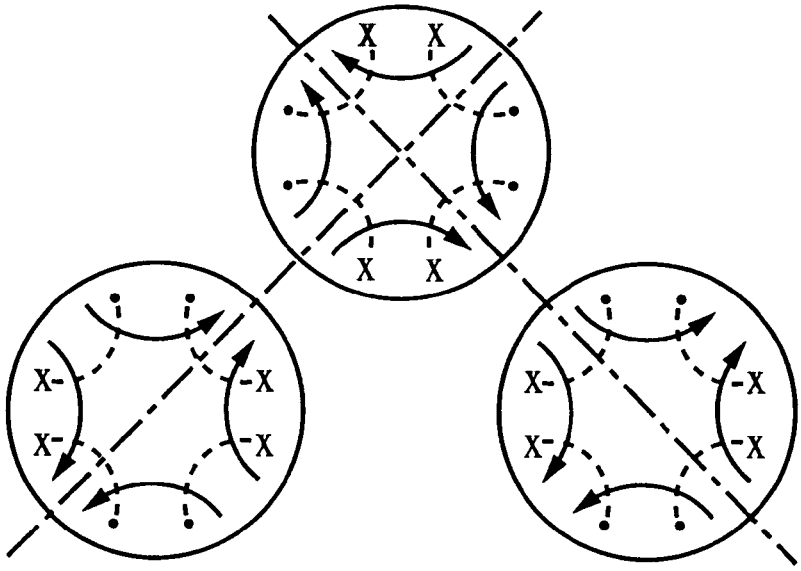

Although the three dielectric resonators are aligned linearly in the first through third embodiments, the fourth embodiment adopts an arrangement which does not have the individual lines connecting the centers of adjacent dielectric resonators coinciding on the same line. In examples shown in FIGS. 5A and 5B, an angle of 45 degrees is formed between the line connecting the dielectric resonators Ra and Rb and the line perpendicular to the probe 6; and similarly, an angle of 45 degrees is formed between the line connecting the dielectric resonator Rb and Rc and the line perpendicular to the probe 7. FIG. 5B shows the state of coupling of the HE210-mode. Regarding the dielectric resonators Ra and Rc and the probes 6 and 7, HE210-mode coupling is possible in addition to coupling of the TE010 mode as the main mode. However, since coupling of the HE210-mode is difficult to occur in the positional relationships between the dielectric resonators Ra and Rb and between the dielectric resonators Rb and Rc, spurious response of the HE210 mode can be suppressed.

Figure 6A:
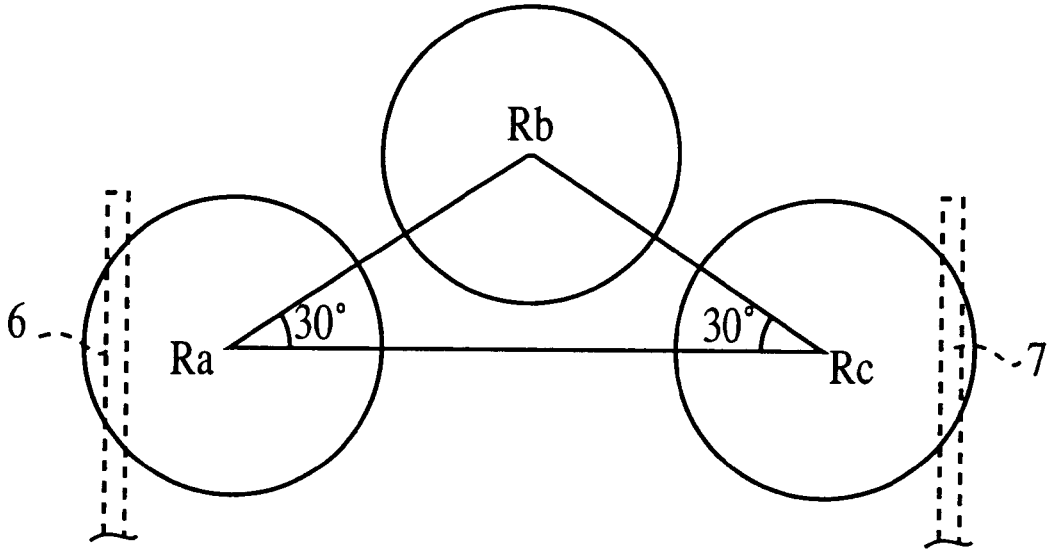
FIGS. 6A and 6B show another example in which each dielectric resonator of the dielectric filter is disposed.
Figure 6B:
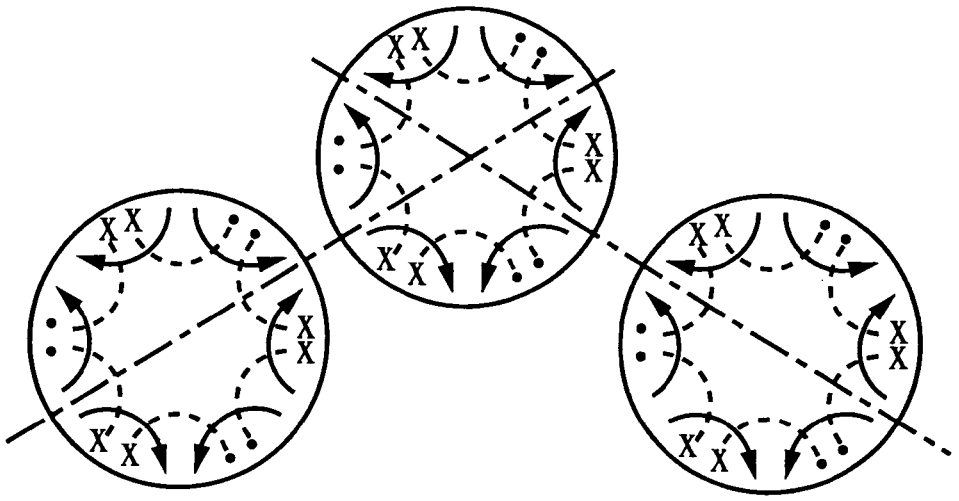

In the examples shown in FIGS. 6A and 6B, an angle of 30 degrees is formed between the line connecting the dielectric resonators Ra and Rb and the line perpendicular to the probe 6; and similarly, an angle of 30 degrees is formed between the line connecting the dielectric resonators Rb and Rc and the line perpendicular to the probe 7. FIG. 6B shows the state of HE310-mode coupling. Regarding the dielectric resonators Ra and Rc and the probes 6 and 7, HE310-mode coupling is possible in addition to coupling of the TE010 mode as the main mode. However, since the HE310-mode coupling is difficult in terms of positional relationships between the dielectric resonators Ra and Rb and between the dielectric resonators Rb and Rc, spurious response of the HE310 mode can be suppressed.

Figure 7:
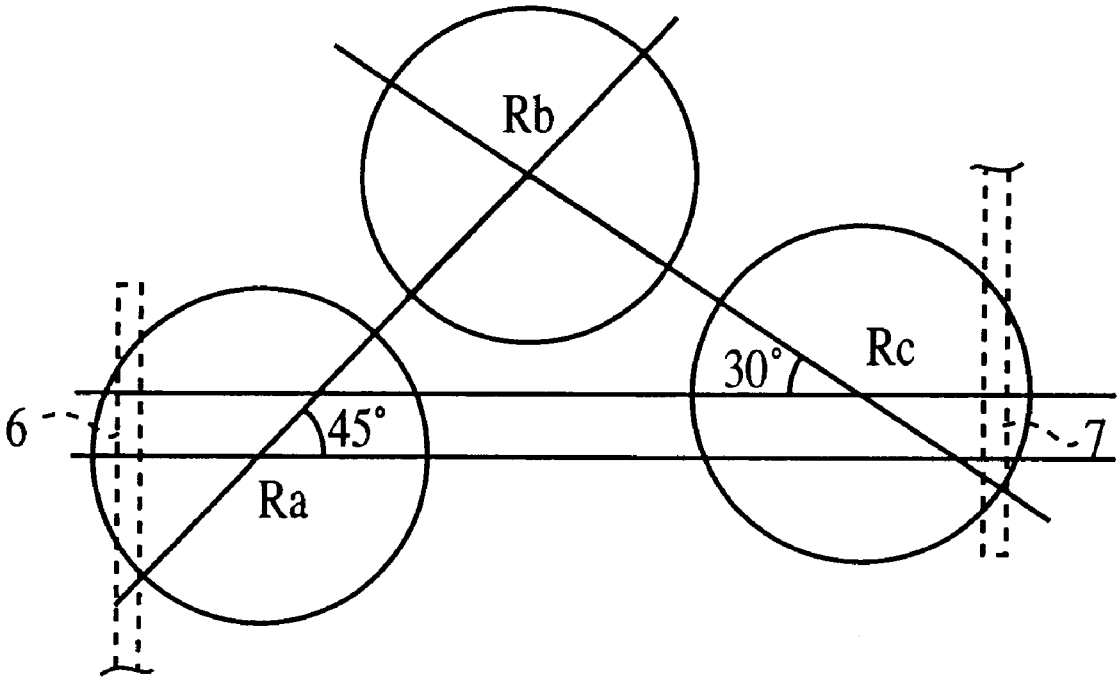
FIG. 7 shows another example in which each dielectric resonator of the dielectric filter is disposed.

In examples shown in FIG. 7, an angle of 45 degrees is formed between the line connecting the dielectric resonators Ra and Rb and the line perpendicular to the probe 6; and similarly, an angle of 30 degrees is formed between the line connecting the dielectric resonators Rb and Rc and the line perpendicular to the probe 7. Regarding the dielectric resonators Ra and Rc and the probes 6 and 7, coupling of the HE210 mode or HE310 mode is possible in addition to coupling of the TE010 mode as the main mode. However, coupling of the HE210 mode in the positional relationship between the dielectric resonators Ra and Rb is difficult; and coupling of the HE310 mode in the positional relationship between the dielectric resonators Rb and Rc is difficult. Thus, spurious responses of the HE210 mode and the HE310 mode can simultaneously be suppressed.

Figure 8:
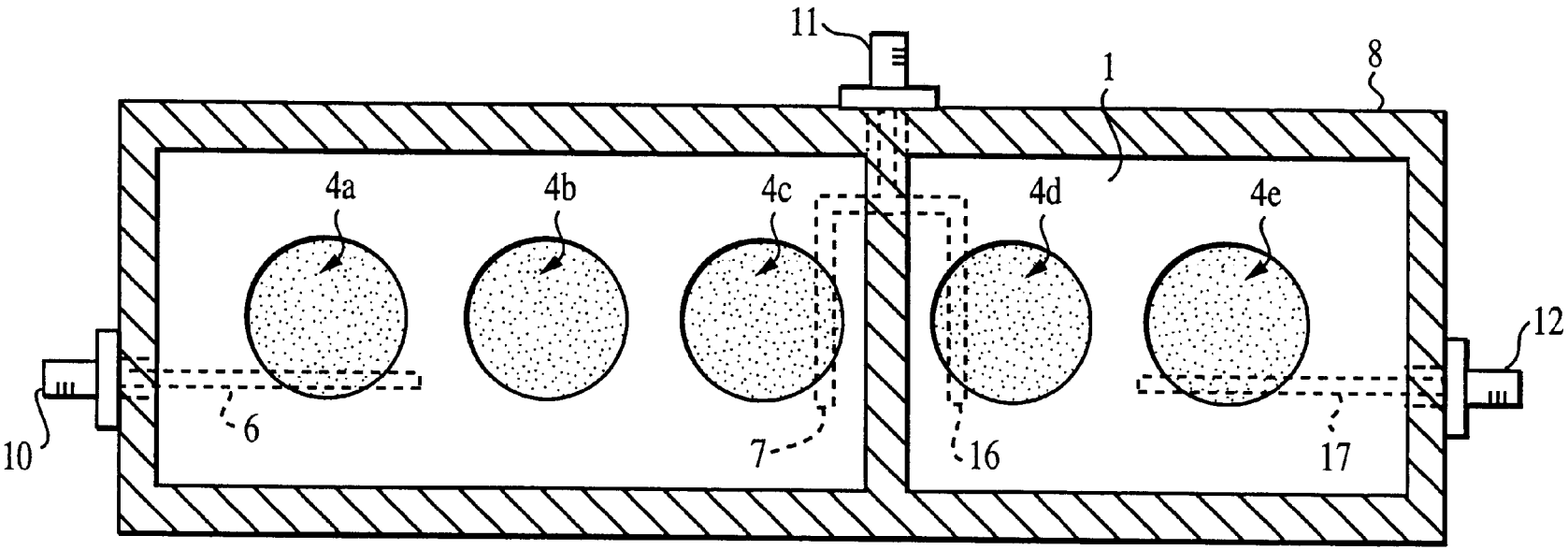
FIG. 8 shows a structure of a transmission-reception shared unit according to a fifth embodiment of the present invention.

Referring now to FIG. 8, a description will be given of a structure of a transmission-reception shared unit according to a fifth embodiment of the present invention.

FIG. 8 is a plan view of the transmission-reception shared unit in a state where the upper conductor plate is removed. The entire basic structure is the same as that of the aforementioned dielectric filter having two ports. In this arrangement, on the upper surface of a dielectric plate, an electrode 1 is formed having five electrodeless parts which are indicated by 4*a,* 4*b,* 4*c,* 4*d,* and 4*e;* and on the lower surface of the dielectric plate, another electrode is formed having electrodeless parts opposing the electrodeless parts 4*a* through 4*e.* This arrangement allows five TE010-mode dielectric resonators to be formed on the single dielectric plate. Coaxial connectors 10, 11, and 12 are disposed in the cavity 8 with the probes 6, 7, 16, and 17 protruding from the respective central conductors of the connectors. The probes 7 and 16 have a form in which they are branched at a specified point from the central conductor of the coaxial connector 11.

In this structure, the coaxial connector 10 is used as a receiving signal output port, the coaxial connector 12 is used as a transmitting signal input port, and the coaxial connector 11 is used as an I/O port; the three dielectric resonators formed at the electrodeless parts 4*a,* 4*b,* and 4*c* are used as a receiving filter comprising the three resonators; and the two dielectric resonators formed at the electrodeless parts 4*d* and 4*e* are used as a transmitting filter comprising the two resonators.

The electrical length between the equivalent short-circuit surface of a first dielectric resonator of the receiving filter and the branching point of the probes 7 and 16 is set to an odd multiple of ¼ the wavelength of the wavelength of the transmitting frequency; and the electrical length between the equivalent short-circuit surface of a last dielectric resonator of the transmitting filter and the branching point of the probes 7 and 16 is set to an odd multiple of ¼ the wavelength of the wavelength of the receiving frequency. This permits branching of transmitting signals and receiving signals.

The above-described arrangement permits both the receiving filter and transmitting filter to have band-pass filter characteristics in which the HE110 mode is suppressed.

Figure 9:
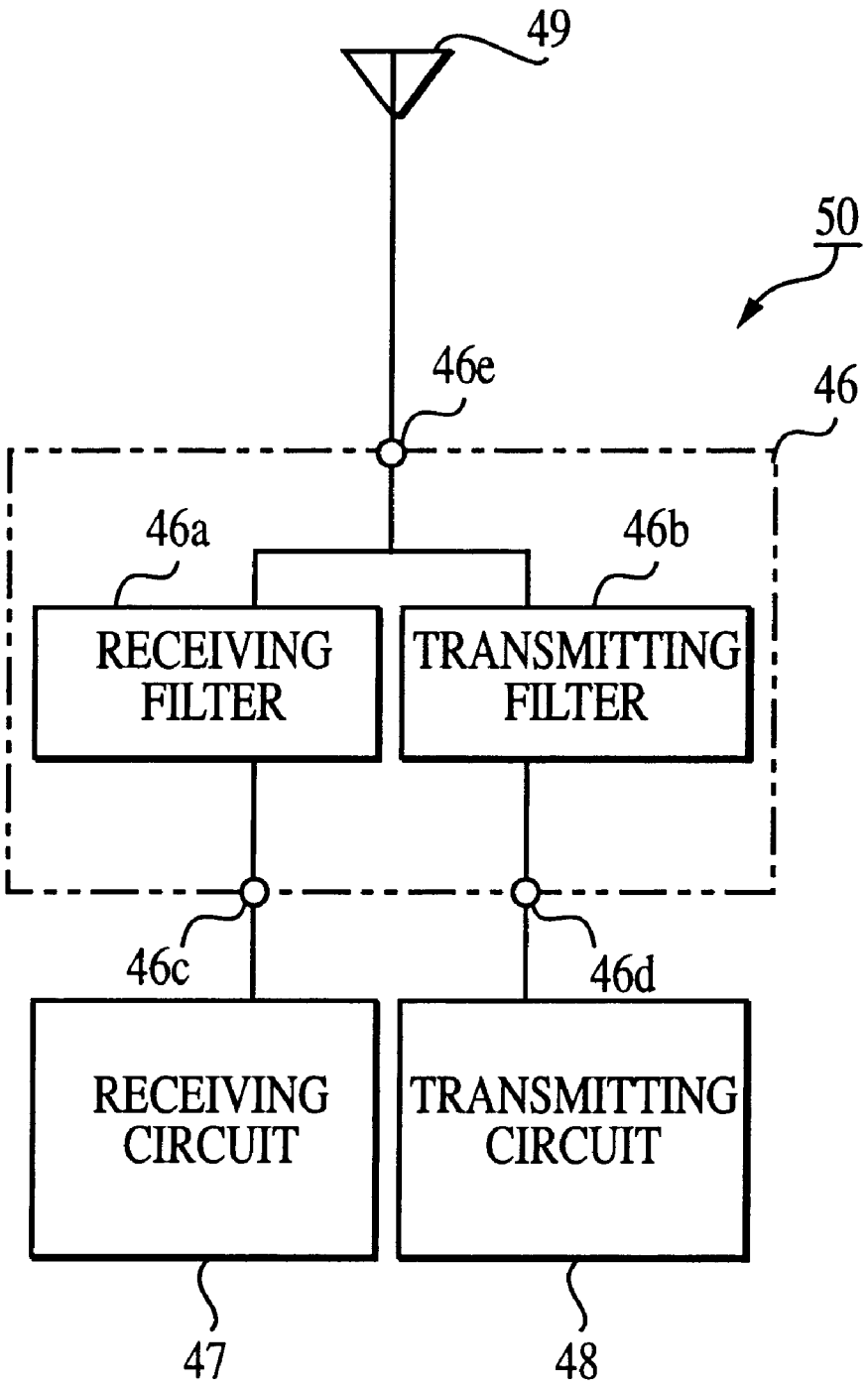
FIG. 9 is a block diagram illustrating a structural example of a transceiver.
Figure 10A:
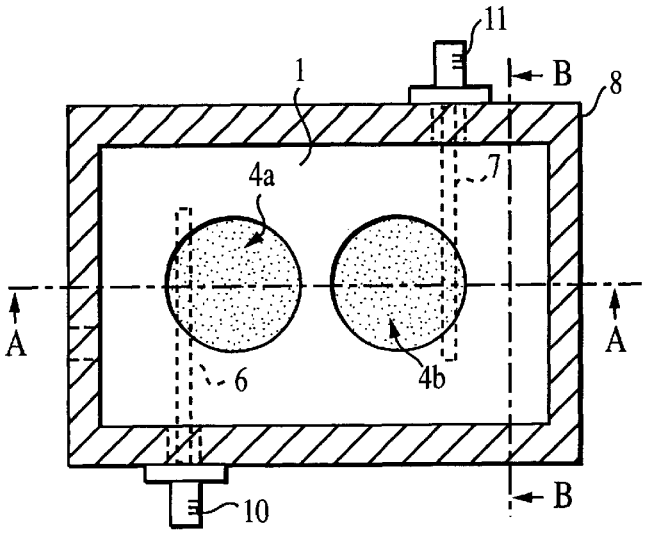
FIG. 10A PRIOR ART
FIGS. 10A, 10B, and 10C respectively show a structural example of a conventional dielectric filter.
Figure 10B:
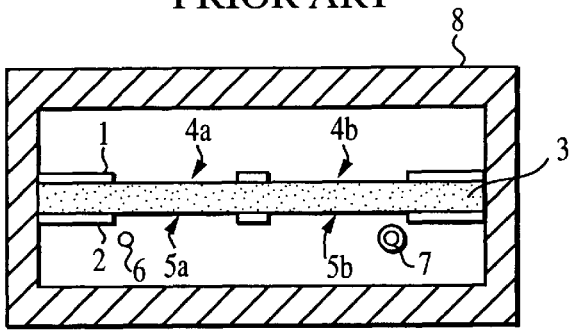
FIG. 10B PRIOR ART
Figure 10C:
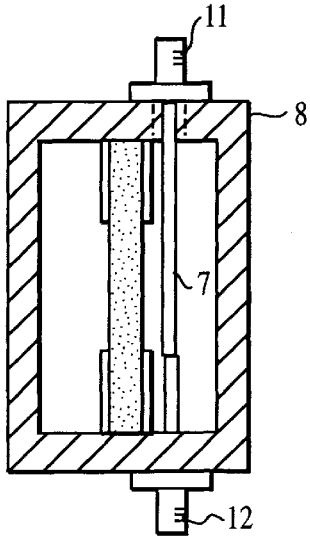
FIG. 10C PRIOR ART
Figure 11:
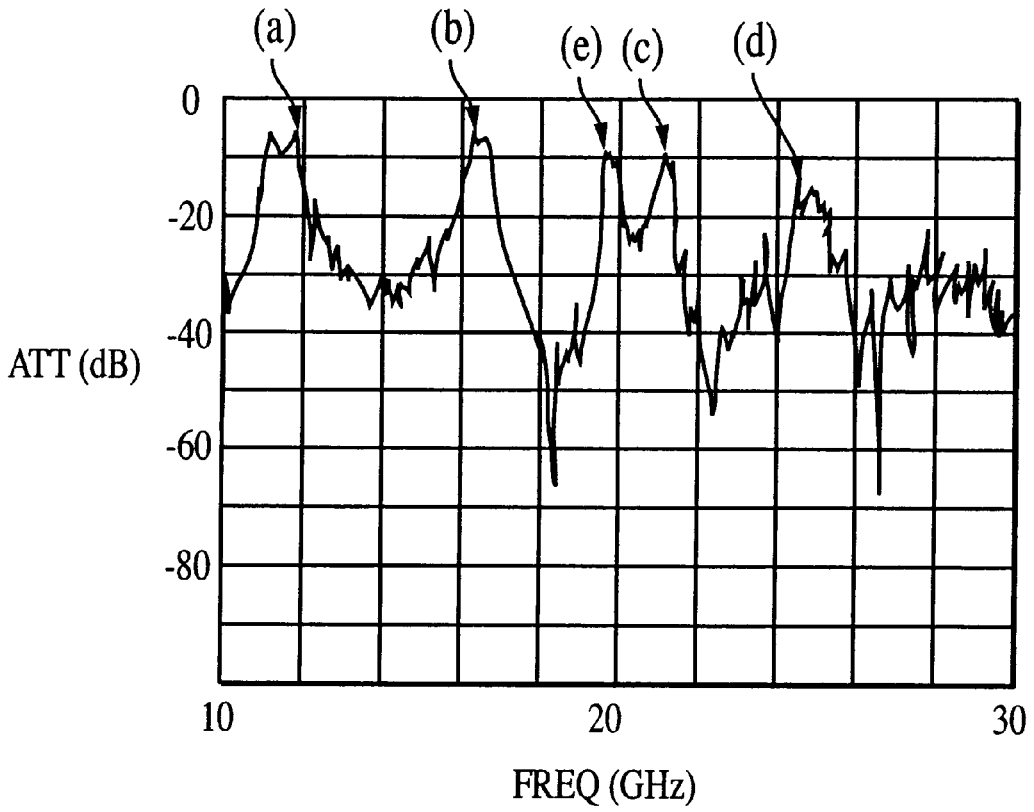
FIG. 11 PRIOR ART
FIG. 11 is a graph showing blocking-band attenuation characteristics of the conventional dielectric filter.

FIG. 9 shows an embodiment of a transceiver using the above transmission-reception shared unit as an antenna-shared unit. In this figure, reference numeral 46*a* denotes the above receiving filter; reference numeral 46*b* denotes the above transmitting filter; and the part indicated by reference numeral 46 comprises the antenna-shared unit. As shown in the figure, a receiving circuit 47 is connected to the receiving signal output port 46*c* of the antenna-shared unit 46; a transmitting circuit 48 is connected to the transmitting signal input port 46*d* of the antenna-shared unit 46; and an antenna 49 is connected to the I/O port 46*e* of the antenna-shared unit 46. This permits overall construction of a transceiver 50.

Using the antenna-shared unit having good branching characteristics allows formation of a small and highly efficient transceiver.

The present invention provides a dielectric filter comprising a dielectric plate having a plurality of dielectric resonators thereon, and transmission of spurious mode through adjacent dielectric resonators can be controlled so as to suppress spurious responses. This can improve blocking-band attenuation characteristics of the dielectric filter, so that a dielectric filter with good attenuation characteristics, a transmission-reception shared unit with good branching characteristics, and a transceiver with high efficiency can be obtained.

In addition, this invention permits selective suppression of specified spurious modes so as to effectively reduce the influence of spurious modes.

What is claimed is:

1. A dielectric filter comprising:

a dielectric plate;

a first electrode formed on a first main surface of the dielectric plate, parts of the electrode being electrodeless;

a second electrode formed on a second main surface of the dielectric plate, parts of the second electrode opposed to the electrodeless parts of the first main surface being electrodeless;

wherein the electrodeless parts of the dielectric plate form dielectric resonators; and wherein the dielectric resonators are aligned in a line;

at least one linearly-formed coupling member which overlaps and is coupled with a specified one of the electric resonators;

said line and said coupling member defining an angle which has a specified number of degrees other than 90 degrees.

2. A dielectric filter according to claim 1, wherein the specified number of degrees is 0 degrees.

3. A dielectric filter according to claim 1, wherein the specified number of degrees is set between 0 and 90 degrees.

4. A dielectric filter comprising:

a dielectric plate;

a first electrode formed on a first main surface of the dielectric plate, parts of the electrode being electrodeless; and a second electrode formed on a second main surface of the dielectric plate, parts of the second electrode opposed to the electrodeless parts of the first main surface being electrodeless;

wherein the electrodeless parts of the dielectric plate form dielectric resonators;

wherein at least one linearly-formed coupling member overlaps and is coupled with a specified one of the dielectric resonators; and wherein the dielectric resonators are disposed in such a manner that lines connecting the centers of respective adjacent dielectric resonators do not mutually coincide on the same line.

5. A duplexer comprising a pair of filters, one of said filters being used as a transmitting filter and the other of said filters being used as a receiving filter; the transmitting filter being connected between a transmitting signal input port and an I/O port; and the receiving filter being connected between a receiving signal output port and the I/O port, wherein at least one of said filters is a dielectric filter comprising:

a dielectric plate;

a first electrode formed on a first main surface of the dielectric plate, parts of the electrode being electrodeless;

a second electrode formed on a second main surface of the dielectric plate, parts of the second electrode opposed to the electrodeless parts of the first main surface being electrodeless;

wherein the electrodeless parts of the dielectric plate form dielectric resonators; and wherein the dielectric resonators are aligned in a line;

at least one linearly-formed coupling member which overlaps and is coupled with a specified one of the dielectric resonators;

said line and said coupling member defining an angle which has a specified number of degrees other than 90 degrees.

6. The duplexer of claim 5, wherein in said at least one of said filters, said specified number of degrees is 0 degrees.

7. The duplexer of claim 5, wherein in said at least one of said filters, said specified number of degrees is set between 0 and 90 degrees.

8. A transceiver comprising:

a duplexer comprising a pair of filters, one of said filters being used as a transmitting filter and the other of said filters being used as a receiving filter; the transmitting filter being connected between a transmitting signal input port and an I/O port; and the receiving filter being connected between a receiving signal output port and the I/O port, wherein at least one of said filters is a dielectric filter comprising:

a dielectric plate;

a first electrode formed on a first main surface of the dielectric plate, parts of the electrode being electrodeless;

a second electrode formed on a second main surface of the dielectric plate, parts of the second electrode opposed to the electrodeless parts of the first main surface being electrodeless;

wherein the electrodeless parts of the dielectric plate form dielectric resonators; and wherein the dielectric resonators are aligned in a line;

at least one linearly-formed coupling member which overlaps and is coupled with a specified one of the dielectric resonators;

said line and said coupling member defining an angle which has a specified number of degrees other than 90 degrees, wherein a transmitting circuit is connected to the transmitting signal input port of the duplexer; a receiving circuit is connected to the receiving signal output port of the duplexer; and an antenna connector is connected to the I/O port of the duplexer.

9. The transceiver of claim 8, wherein in said at least one of said filters, said specified number of degrees is 0 degrees.

10. The transceiver of claim 8, wherein in said at least one of said filters, said specified number of degrees is set between 0 and 90 degrees.

11. A duplexer comprising a pair of filters, one of said filters being used as a transmitting filter and the other of said filters being used as a receiving filter, the transmitting filter being connected between a transmitting signal input port and an I/O port; and the receiving filter being connected between a receiving signal output port and the I/O port, wherein at least one of the filters is a dielectric filter comprising:

a dielectric plate;

a first electrode formed on a first main surface of the dielectric plate, parts of the electrode being electrodeless; and a second electrode formed on a second main surface of the dielectric plate, parts of the second electrode opposed to the electrodeless parts of the first main surface being electrodeless;

wherein the electrodeless parts on the dielectric plate form dielectric resonators;

wherein at least one linearly-formed coupling member overlaps and is coupled with a specified one of the dielectric resonators; and wherein the dielectric resonators are disposed in such a manner that lines connecting the centers of respective adjacent dielectric resonators do not mutually coincide on the same line.

12. A transceiver comprising:

a duplexer comprising a pair of filters, one of said filters being used as a transmitting filter and the other of said filters being used as a receiving filter; the transmitting filter being connected between a transmitting signal input port and an I/O port; and the receiving filter being connected between a receiving signal output port and the I/O port, wherein at least one of said filters is a dielectric filter comprising:

a dielectric plate;

a first electrode formed on a first main surface of the dielectric plate, parts of the electrode being electrodeless; and a second electrode formed on a second main surface of the dielectric plate, parts of the second electrode opposed to the electrodeless parts of the first main surface being electrodeless;

wherein the electrodeless parts on the dielectric plate form dielectric resonators;

wherein at least one linearly-formed coupling member overlaps and is coupled with a specified one of the dielectric resonators;

wherein the dielectric resonators are disposed in such a manner that lines connecting the centers of respective adjacent dielectric resonators do not mutually coincide on the same line; and wherein a transmitting circuit is connected to the transmitting signal input port of the duplexer; a receiving circuit is connected to the receiving signal output port of the duplexer; and an antenna connector is connected to the I/O port of the duplexer.

* * * * *